US005570552A

United States Patent [19]

Nehring

[11] Patent Number: 5,570,552

[45] Date of Patent: Nov. 5, 1996

[54] UNIVERSAL WALL FORMING SYSTEM

[76] Inventor: Alexander T. Nehring, P.O. Box 209, Ridgefield, Conn. 06877

[21] Appl. No.: 382,988

[22] Filed: Feb. 3, 1995

[51] Int. Cl.[6] ..... E04B 2/84; E04G 11/06

[52] U.S. Cl. ..... 52/426; 52/564; 249/91

[58] Field of Search ..... 52/562, 564, 565, 52/568, 426, 427, 425, 442, 687, 677, 438; 249/91, 213, 218

[56] References Cited

U.S. PATENT DOCUMENTS

| | | | |
|---|---|---|---|
| 2,099,260 | 11/1937 | Colt | 249/213 |
| 2,546,043 | 3/1951 | Parmenter | 249/213 X |
| 3,530,634 | 9/1970 | Adams | 249/91 X |
| 4,223,501 | 9/1980 | DeLozier . | |
| 4,439,967 | 4/1984 | Dielenberg . | |
| 4,706,429 | 11/1987 | Young . | |
| 4,730,422 | 3/1988 | Young | 52/562 X |
| 4,765,109 | 8/1988 | Boeshart | 52/562 X |
| 4,866,891 | 9/1989 | Young | 57/426 X |
| 4,884,382 | 12/1989 | Horobin . | |
| 4,894,969 | 1/1990 | Horobin . | |
| 4,938,449 | 7/1990 | Boeshart | 52/562 X |
| 4,967,528 | 11/1990 | Doran . | |
| 5,014,480 | 5/1991 | Guarriello et al. . | |
| 5,086,600 | 2/1992 | Holland et al. . | |
| 5,390,459 | 2/1995 | Mensen | 52/426 |
| 5,428,933 | 7/1995 | Philippe | 52/564 X |

FOREIGN PATENT DOCUMENTS

| | | | |
|---|---|---|---|
| 11785 | 3/1933 | Australia | 52/438 |

*Primary Examiner*—Lanna Mai
*Attorney, Agent, or Firm*—Albert W. Hilburger

[57] ABSTRACT

A modular wall construction system includes a box-like block form of expanded foam plastic material such as polystyrene having opposite, parallel, spaced apart sidewalls and endwalls extending between upper and lower surfaces and defining an internal cavity for receiving concrete slurry. A plurality of transverse bridge members maintain spacing between the sidewalls at spaced locations along the length thereof. Each bridge member includes a central web extending between opposed tongues which are slidably received in T-grooves formed in the sidewalls. A cylindrical boss member is integral with the central web and substantially equidistant between the opposed tongues and has an outer peripheral surface and a vertically extending bore for slidably receiving a vertical reinforcement bar. The central web has opposed inclined upper edges which descend, respectively, from the tongues toward the boss member such that horizontal reinforcement bars are receivable, respectively, at the intersection between the cylindrical boss and the upper edges of the central web. The mutually interlocking construction on the sidewalls and bridge members enables the slidable reception of the bridge members on the sidewalls in a first direction while preventing substantial movement therebetween in a second, transverse, direction. Upper and lower surfaces of the sidewalls and endwalls have an interlocking construction enabling them to be joined together when a plurality of the sidewalls and endwalls are stacked, respectively, in a vertical relationship to form a building structure.

17 Claims, 4 Drawing Sheets

FIG. 1
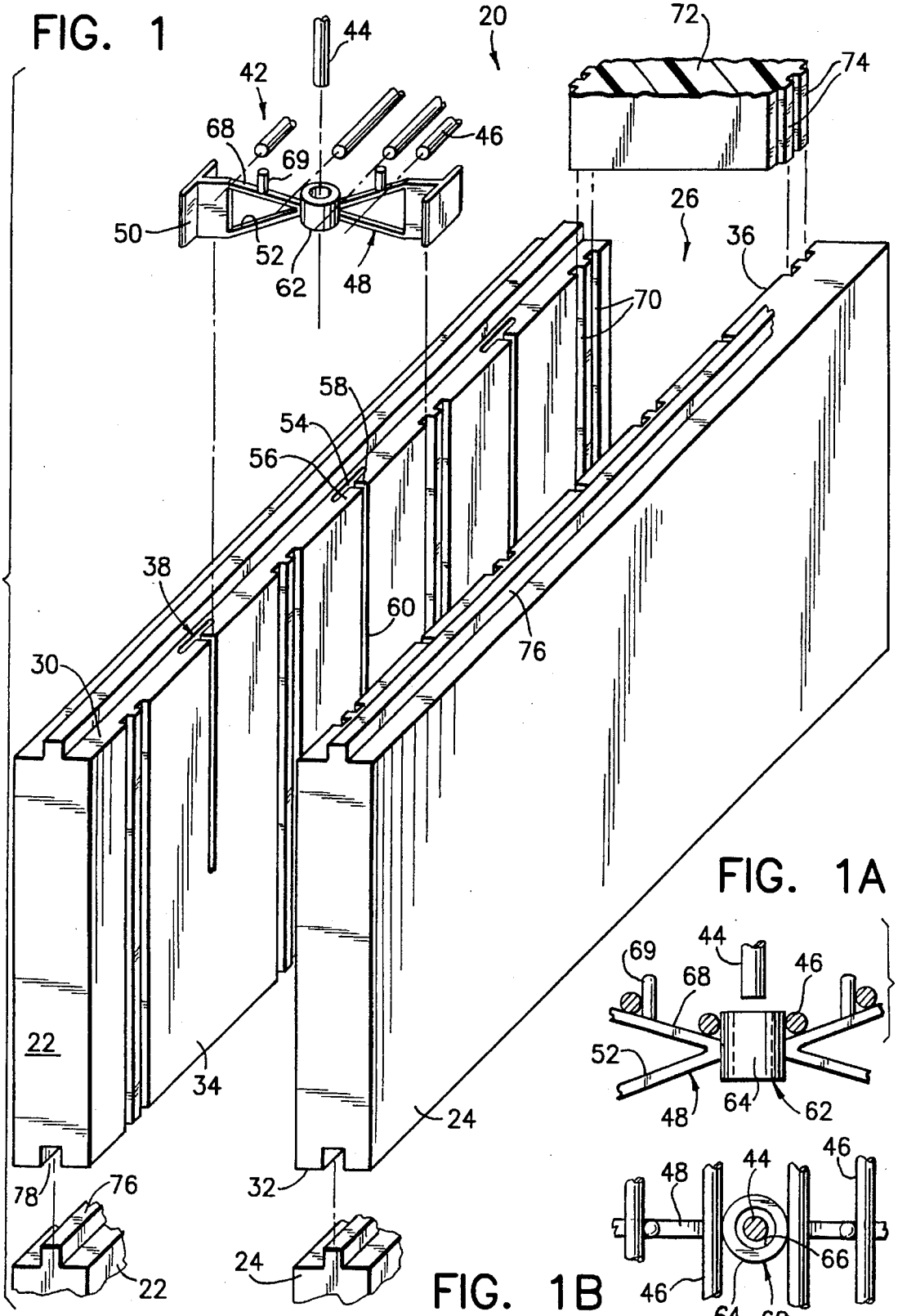
FIG. 1A
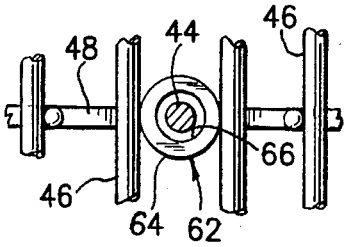
FIG. 1B

UNIVERSAL WALL FORMING SYSTEM

BACKGROUND OF THE INVENTION

1. Field of the Invention

The present invention relates generally to building construction using interlocking building blocks for concrete structures and, more particularly, to a novel system for constructing the walls of a structure using new and improved interlocking block forms and associated components to aid in the building of various concrete structures such as walls and the like, wherein concrete in slurry form is poured into the body cavity of the block forms and thereby becomes a part of the permanent wall structure.

2. Description of the Prior Art

For many years, footings and walls constructed of concrete have customarily required a combination of metal and wooden forms which are erected in place after a proper excavation has been made. Thereafter, concrete is poured into the cavity defined by the form and allowed to harden. When the concrete is sufficiently hard, typically after a day or two, the forms are removed. Some parts of the forms can be re-used and others must be discarded. Also, the described activity is labor intensive. In short, current practice results in a substantial amount of waste, both time-wise and material-wise.

More recently, with the advent of light weight plastic foam materials, a number of constructions have been suggested for use as external wall forms for receiving concrete having a slurry composition.

There is a problem in the prior art, however, in that there do not exist suitable block forms that include all of the necessary components and configurations that are required to meet the strict adherence to sound constructive practices and guidelines in the construction of concrete wall structures and the like. This is a particularly acute problem when a structure is to employ a hollow-type block form that incorporates a synthetic plastic material that must withstand the high stress placed upon the walls of the block form as concrete is being poured therein.

There are many known devices and block systems that have been employed and are presently being used in building wall structures, in attempting to solve many structural problems without causing limitations in use as well as restrictions in applications to particular situations or circumstances. However, there remains a need for a new, novel arrangement of a concrete block form that can become more universally accepted in the industry.

Accordingly, it is felt that the present invention overcomes many of the faults of known block forms, particularly those forms that use synthetic plastic material.

As examples of various known wall forming blocks, attention is directed to the following U.S. patents.

U.S. Pat. No. 4,439,967 issued Apr. 3, 1984 to Dielenberg discloses formwork elements for building purposes having a hollow block configuration produced from a hard-foam resin material, and adapted to be filled with concrete to establish a rigid wall having insulating properties.

U.S. Pat. No. 4,706,429 issued Nov. 17, 1987 to Young discloses a modular, synthetic plastic, concrete-form structure which comprises a pair of modular, concrete-forming panels that are interconnected by a plurality of plastic cross-ties that slidably engage the oppositely positioned side panels. The side panels also include end panels which are used as end closures to confine the concrete within the modular constructed form.

The following U.S. patents all disclose block forms of such light weight plastic foam material, each with a tongue and groove construction for erecting concrete walls: U.S. Pat. No. 4,894,969 issued Jan. 23, 1990 to Horobin, U.S. Pat. No. 4,967,528 issued Nov. 6, 1990 to Doran, and U.S. Pat. No. 5,086,600 issued Feb. 11, 1992 to Holland et al.

It was in light of the foregoing state of the prior art that the present invention was conceived and now has been reduced to practice.

SUMMARY OF THE INVENTION

A modular wall construction system comprises a box-like block form of expanded foam plastic material such as polystyrene having opposite, parallel, spaced apart sidewalls and endwalls extending between upper and lower surfaces and defining an internal cavity for receiving concrete slurry. A plurality of transverse bridge members maintain spacing between the sidewalls at spaced locations along the length thereof. Each bridge member includes a central web extending between opposed tongues which are slidably received in T-grooves formed in the sidewalls. A cylindrical boss member is integral with the central web and substantially equidistant between the opposed tongues and has an outer peripheral surface and a vertically extending bore for slidably receiving a vertical reinforcement bar. The central web has opposed inclined upper edges which descend, respectively, from the tongues toward the boss member such that horizontal reinforcement bars are receivable, respectively, at the intersection between the cylindrical boss and the upper edges of the central web. The mutually interlocking construction on the sidewalls and bridge members enables the slidable reception of the bridge members on the sidewalls in a first direction while preventing substantial movement therebetween in a second, transverse, direction. Upper and lower surfaces of the sidewalls and endwalls have an interlocking construction enabling them to be joined together when a plurality of the sidewalls and endwalls are stacked, respectively, in a vertical relationship to form a building structure.

Accordingly, it is a primary object of the invention to provide a novel system for constructing the walls of a structure.

It is another important object of the present invention to provide a monolithic concrete block form of construction that is an improvement over the prior art and is capable of being used in structures that have been limited to the use of known synthetic or plastic block forms.

It is a further object of the invention to provide a concrete block form of construction that utilizes expandable polystyrene material which is lightweight but rigid in structure, and is adapted to withstand the internal force created by the concrete when it is poured into the body cavity thereof. Still another object of the invention is to provide a block form of this type that includes means for interlocking stacked forms without requiring mortar or any other binder interposed between the juxtaposed block forms in order to erect a structure.

A further object of the present invention is to provide a construction of this character that is so designed that it is safe and easy to work with, allowing unskilled workers to be employed in building wall structures.

Still a further object of the present invention is to provide a concrete-block form that is scored with equally spaced cutting seems to allow the block form to be readily cut to a specific length, as needed.

Another object of the invention is to provide such a system which can be easily used and employs readily available, and easily formable, materials and which results in minimal waste of materials. The primary material preferably employed for purposes of the invention is an expanded plastic such as polystyrene.

A further object of the invention is to provide such a system which is economical from a standpoint of fabrication as well as from a standpoint of use.

Still another object of the invention is to provide such a system which can be safely used and is environmentally inert.

Yet another object of the invention is to provide such a system which utilizes components which are relatively compact, light in weight, portable, and which can be preassembled away from the job site, then finally assembled at the job site with minimal additional effort.

Still a further object of the invention is to provide such a system which can enable persons having minimal experience to successfully fabricate structural foundations and without requiring the use of special tools.

Yet another object of the invention is to provide for the construction of a foundation in a manner which assures integrity between footing and walls and thereby prevents penetration of radon into the resulting structure.

Yet a further object of the invention is the provision of a system enabling the continuous pour of concrete for footing, walls, and concrete slab.

Yet another object of the invention is to provide a modular wall construction system as previously related in which each of the sidewalls is of substantially rectangular shape having upper and lower longitudinally extending surfaces and first and second interior surfaces, respectively, extending between the upper and lower surfaces and facing the cavity and having a plurality of longitudinally spaced vertical T-grooves therein, each T-groove extending from the upper surface and terminating at a shoulder intermediate the upper and lower surfaces and in which each of the bridge members includes a central web extending between first and second tongues extending transversely of the central web for interlocking slidable engagement with the vertically extending T-grooves and in which each of the first retention members includes a cylindrical boss member integral with the central web and substantially equidistant between the first and second tongues, the boss member having an outer peripheral surface and a vertically extending bore therein for slidably receiving a vertical reinforcement bar, and in which the central web has opposed inclined upper edges descending from the first and second tongues toward the boss member enabling reinforcement bars to be receivable, respectively, at the intersection between the outer surface of the cylindrical boss and the upper edges.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate some of the embodiments of the invention and, together with the description, serve to explain the principles of the invention in general terms. Like numbers refer to like parts throughout the disclosure.

BRIEF DESCRIPTION OF THE DRAWINGS

FIG. 1 is an exploded perspective view illustrating a universal wall forming system embodying the present invention;

FIGS. 1A and 1B are detail front elevation and top plan views, respectively, illustrating components of the system depicted in FIG. 1;

DETAILED DESCRIPTION OF THE PREFERRED EMBODIMENTS

Figure 2:
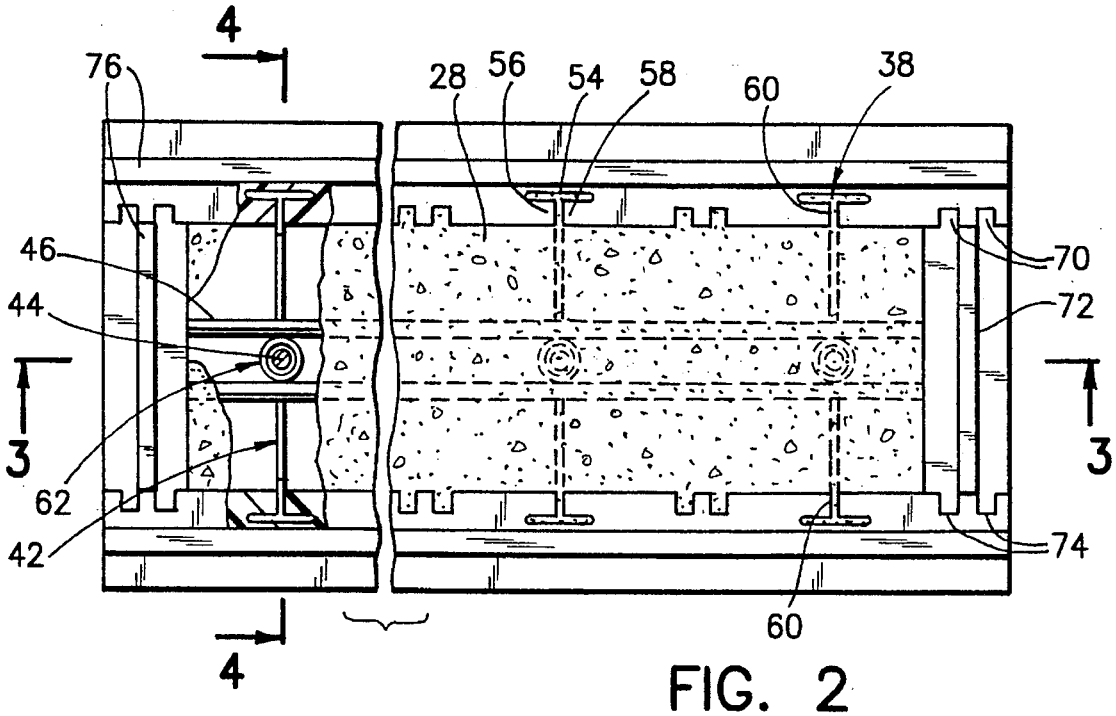
FIG. 2 is a top plan view of an assembled wall forming system as depicted in FIG. 1 but illustrating its final condition, filled with concrete, certain parts being cut away and shown in cross section.
Figure 3:
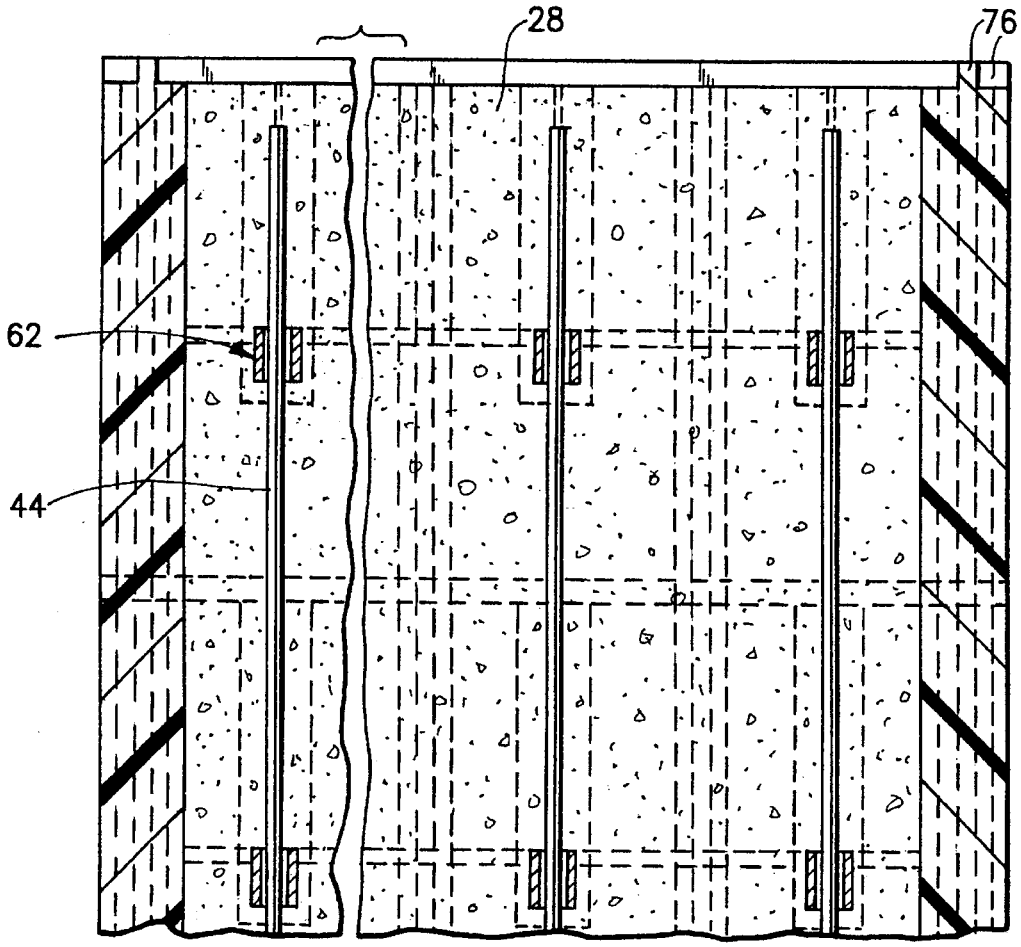
FIG. 3 is a cross section view taken generally along line 3—3 in FIG. 2.
Figure 4:
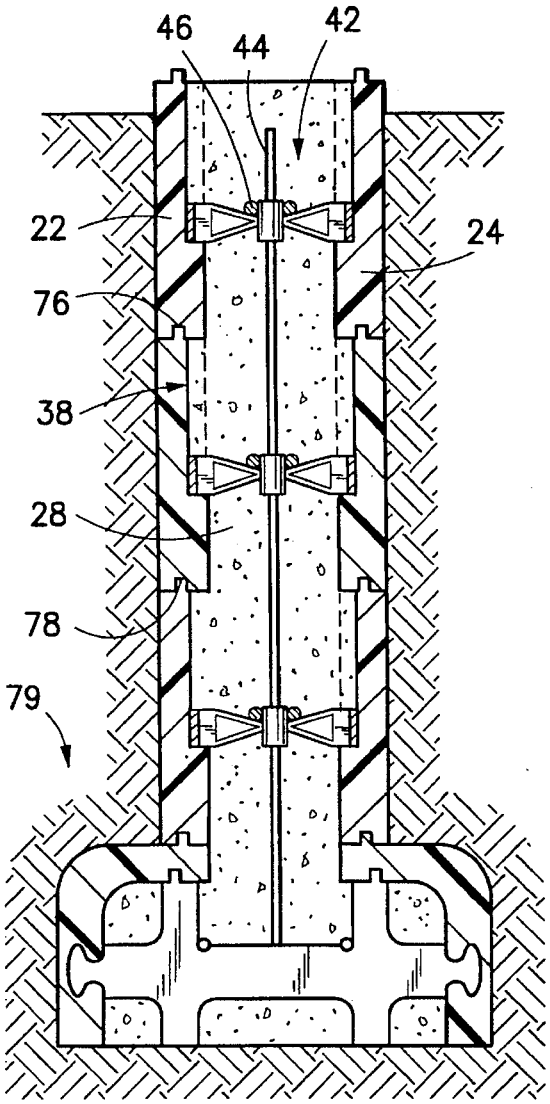
FIG. 4 is a cross section view taken generally along line 4—4 in FIG. 2.

Turn now to the drawings and, initially, to FIG. 1 which generally illustrates a modular wall construction system 20 according to the invention. The system 20 comprises opposed, spaced apart, elongated, congruent sidewalls 22, 24 defining a cavity 26 therebetween for receiving flowable material 28 (FIGS. 2, 3 and 4). The sidewalls 22, 24 are of expanded foam plastic material, polystyrene being a typical example and the flowable material 30 is typically concrete in its slurry form.

For purposes of this disclosure, concrete is considered to be a building material composed of cement, aggregate of sand and stones, and water which hardens to a strong state when the water evaporates. It is customary for the concrete to be poured in a "liquid" or slurry state which is a watery mixture of moderate viscosity. After a period of hours, the concrete hardens to an extent that it bear substantial loads, but only after a much longer period of time does it cure to its maximum strength. For purposes of the present invention, other suitable materials which have a slurry consistency for introduction into a mold cavity and which harden to a structure-bearing ability are intended to be included by that term even though they may not be strictly within the definition of concrete.

Each of the sidewalls 22, 24 is of substantially rectangular shape having upper and lower longitudinally extending surfaces 30, 32 and opposed interior surfaces 34, 36, respectively, extending between the upper and lower surfaces and facing the cavity 26. A plurality of longitudinally spaced vertical T-grooves 38 are provided in the interior surfaces 34, 36, each T-groove extending from the upper surface 30 and terminating at a shoulder 40 intermediate the upper and lower surfaces. Each T-groove in the interior surface 34 is positioned directly opposite a mating T-groove in the interior surface 36.

A plurality of transverse bridge members 42 are provided for maintaining uniform spacing between the sidewalls 22, 24, each of the bridge members having opposed ends for fixed attachment, respectively, to the sidewalls at spaced locations along their length. Each of the bridge members includes a first retainer for slidably receiving a nominally vertical reinforcement bar 44 and a second retainer for slidably receiving a pair of nominally horizontal reinforcement bars 46. More specifically, each of the bridge members 42 includes a central web 48 extending between opposed tongues 50 which, in turn, extend transversely of the central web for interlocking slidable engagement with the vertically extending T-grooves in the sidewalls 22, 24, respectively. Preferably, the central web 48 of each of the bridge members is perforated as at 52 to enable the flowable material to flow freely through and around the bridge members and throughout the cavity 26.

A mutually interlocking construction is provided on the sidewalls 22, 24 and on the bridge members for slidable reception of the bridge members into fixed engagement with the sidewalls. More specifically, each of the vertically extending T-grooves 38 in the interior surfaces 34, 36 includes an enlarged channel 54 for slidably receiving one of the associated tongues 50. Additionally, each of the sidewalls 22, 24 includes opposed peninsulas 56, 58 adjacent the T-groove defining a reduced width slot 60 adjacent the associated enlarged channel 54 for slidable reception of the central web 48. Thus, each bridge member 42 is slidably received in its associated opposed T-grooves 38 until its tongues come to rest on the shoulders 40 and, when finally positioned, the bridge member serves to prevent substantial movement between the sidewalls 22, 24 in the transverse direction, that is, toward and away from one another.

It was earlier mentioned that each of the bridge members includes a first retainer for slidably receiving a nominally vertical reinforcement bar 44 and a second retainer for slidably receiving a pair of nominally horizontal reinforcement bars 46. In this regard, the first retainer includes a cylindrical boss member 62 which is integral with the central web and positioned substantially equidistant between the opposed tongues 50. The boss member 62 has an outer peripheral surface 64 and a vertically extending bore 66 therein for slidably receiving therethrough a vertical reinforcement bar 44.

The central web 48 includes opposed inclined upper edges 68, each of which descends from an associated tongue 50 toward the boss member 62. When the horizontal reinforcement bars 46 are laid across a plurality of the spaced bridge members 42, they slide or roll down the incline of each of the upper edges 68, coming to rest at the intersection between the outer peripheral surface 64 of the cylindrical boss member 62 and the upper edges 68. This arrangement is clearly seen in FIGS. 1A and 1B.

In a supplementary construction, allowing for the emplacement of additional horizontal reinforcement bars 46 to achieve maximum strength, viewing FIGS. 1, 1A, and 1B, one or more upright posts 69 may be provided integral with, and projecting upwardly from, each upper edge 68 of the central web 48. The upright posts 69 are located, preferably, at locations substantially equidistant, respectively, from the opposed tongues 50. These posts can thereby receive, in a nesting relationship, additional horizontal reinforcement bars in a manner best illustrated in FIGS. 1A and 1B. Although this construction is only illustrated in FIGS. 1, 1A, and 1B so as not to unduly complicate the remaining illustrations, it is to be understood that the upright posts 69 may be provided whenever proper or desired.

To complete the general description of the modular wall forming system 20, multiple pairs of longitudinally spaced vertically extending mounting grooves 70 are formed at directly opposed locations of the interior surfaces 34, 36 of the sidewalls 22, 24, respectively. Each pair of the mounting grooves 70 extends from the upper surface 30 to the lower surface 32. A pair of endwalls 72 extends transversely of the sidewalls 22, 24 at spaced locations along the length of the sidewalls. Each of the endwalls 72 has a pair of laterally projecting, vertically extending, ribs 74 for fitting reception, respectively, with the mounting grooves 70. The double rib and double groove design just described is particularly effective to contain the concrete slurry which is to be poured into the cavity 26. To further aid in retaining the concrete slurry, suitable adhesive may be applied to the ribs 74 and to the mounting grooves 70 and to their adjoining surfaces before joining the endwalls to the sidewalls.

For building the intended structure in a vertical direction, the sidewalls 22, 24 and endwalls 72 are provided with an interlocking construction on their upper and lower surfaces. This interlocking construction includes a continuous elongated rail member 76 extending along the upper surface of the sidewalls and the endwalls, respectively, and an elongated channel member 78 extending along the lower surface of each of the sidewalls and endwalls. As seen particularly well in FIG. 4, the rail members 76 of the upper surfaces are positioned to be interlocked within respective channel members 78 of the lower surfaces of the sidewalls and of the endwalls, respectively, when a plurality of the sidewalls and the endwalls are stacked, respectively, in a vertical relationship to form a building structure. This is essentially a tongue-in-groove construction, but it will be appreciated that a wide variety of other suitable locking mechanisms may be employed for purposes of the invention.

Figure 4A:
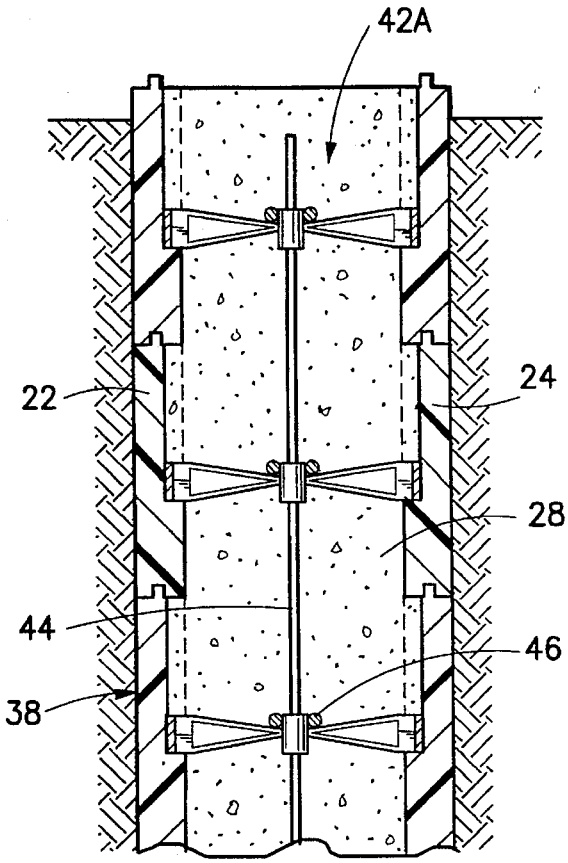
FIGS. 4A and 4B are detail cross section views illustrating a portion of the structure depicted in FIG. 4 but showing different sizes of the structure resulting from the use of different sized components.
Figure 4B:
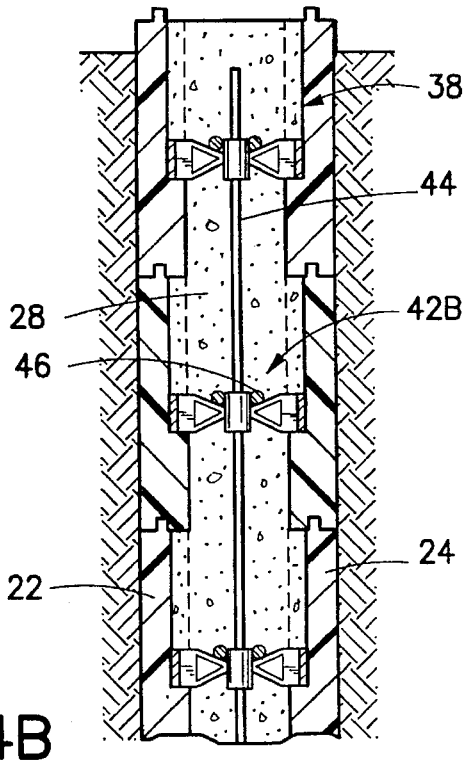

As seen in FIG. 4, an entire wall structure comprising a plurality of levels of opposed sidewalls 22, 24 may be based upon a suitable footing 79 which may be of a construction disclosed in U.S. Pat. No. 5,367,845 to Hartling. FIGS. 4A and 4B illustrate modular wall construction systems similar to that of FIG. 4 with the exception that the bridge members 42A (FIG. 4A) and 42B (FIG. 4B) are of lengths different from the bridge members 42 (FIG. 4). The bridge members 42A are substantially longer than the bridge members 42 resulting in a wall construction of greater thickness while the bridge members 42B are substantially shorter than the bridge members 42 resulting in a wall construction of reduced thickness. Hence, the invention can readily accommodate a broad range of sizes which might be desired for a particular structure.

Figure 5:
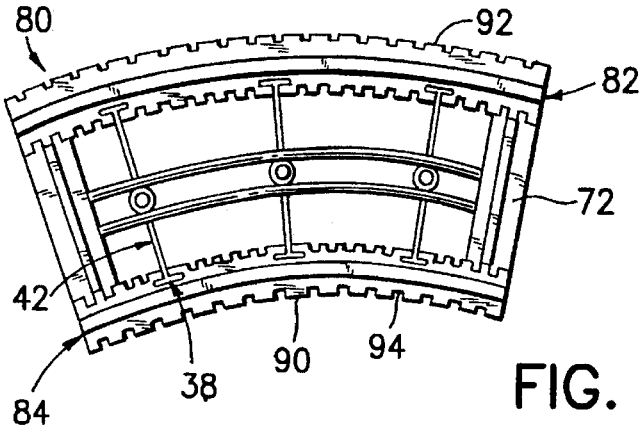
FIG. 5 is a top plan view, similar to FIG. 2, illustrating another shape of structure which can be achieved with the invention.
Figure 5A:
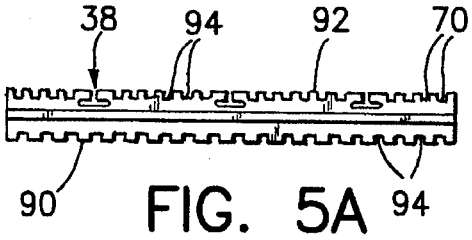
FIG. 5A is a top plan view of an initial condition of a component of the structure illustrated in FIG. 5.
Figure 5B:
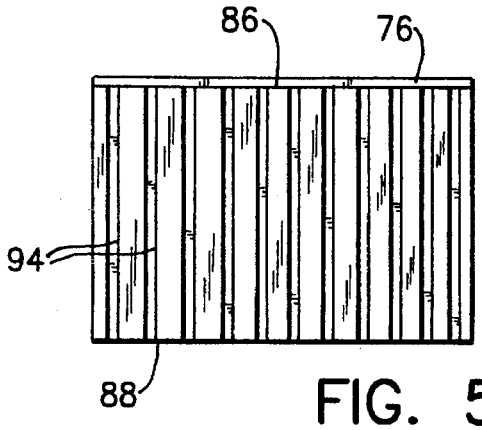
FIG. 5B is a side elevation view of the component illustrated in FIG. 5A.

Turn now to FIGS. 5, 5A, and 5B for a description of another embodiment of the invention. In this instance, a modified modular wall construction system 80 includes opposed sidewalls 82, 84 which, as with sidewalls 22, 24 are of substantially rectangular shape having upper and lower longitudinally extending surfaces 86, 88, respectively. Exterior and interior surfaces 90, 92, respectively, extend between the upper and lower surfaces and a plurality of longitudinally spaced vertically disposed stress relief notches 94 extend from the upper surface to the lower surface. It will be understood that the stress relief notches are so positioned as not to adversely interfere either with the T-grooves 38 for receiving the bridge members 42 or with the mounting grooves 70 for joining the endwalls 72 to the sidewalls 82, 84. By reason of this construction, the sidewalls 82, 84 can be manipulated from a flat planar condition (FIG. 5A) to a curved planar condition (FIG. 5) being curved about a vertical axis which is substantially parallel to the vertically disposed notches.

Figure 6:
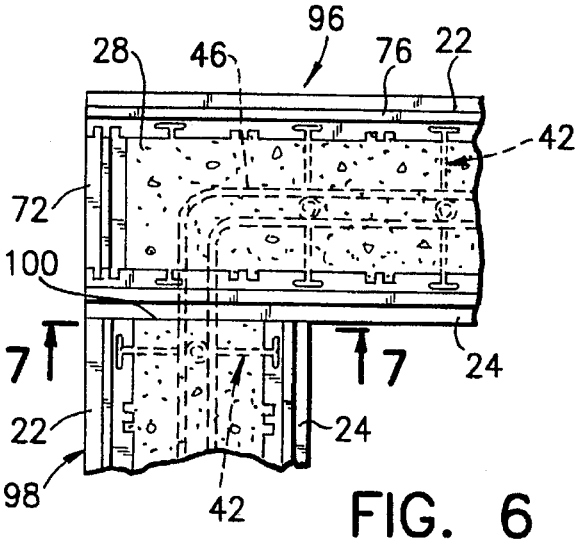
FIG. 6 is a detail top plan view illustrating a corner construction of a structure embodying the present invention.
Figure 7:
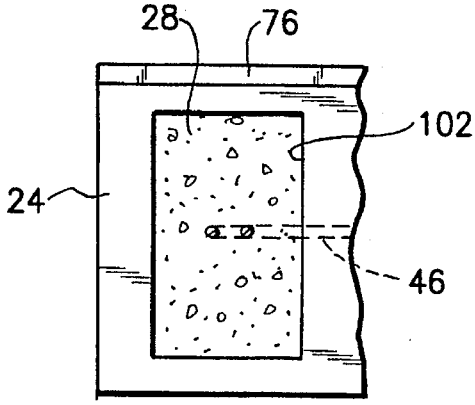
FIG. 7 is a detail cross section view, in elevation, taken generally along line 7—7 in FIG. 6.

FIGS. 6 and 7 illustrate one manner of constructing a corner location using the present invention. In this instance, a pair of box-like wall block forms 96, 98 each comprises a pair of oppositely disposed, parallel, spaced apart sidewalls and wall block form 96 is illustrated with an endwall 72. As previously described, each wall block form similarly includes a plurality of transverse bridge members 42 for maintaining spacing between the sidewalls.

Adhesive may be suitably applied to an end surface 100 of the wall block form 98 and the latter impressed against the outer surface of the sidewall 24 of the wall block form 96 with the outer surface of the sidewall 22 of the wall block form 98 being generally coplanar with the outer surface of the endwall 72 of the wall block form 96. Thereafter, an opening 102 may be suitably cut through the sidewall 24 of the wall block form 96 so as to interconnect the cavities 26 of the two wall block forms. The horizontal reinforcement bars 46 may be suitably bent to turn the corner from the cavity of the wall block form 96 to that of the wall block form 96. By reason of the opening 102, the concrete slurry can readily and freely flow between the cavities 26 of the two wall block forms 96, 98.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A modular wall construction system comprising:

first and second opposed, spaced apart, elongated sidewalls defining a cavity therebetween for receiving flowable material and including upper and lower longitudinally extending surfaces and first and second interior surfaces, respectively, extending between said upper and lower surfaces and facing the cavity and having a plurality of longitudinally spaced vertical T-grooves therein; and a plurality of transverse bridge members for maintaining spacing between said first and second sidewalls, each of said bridge members including a central web extending between first and second tongues extending transversely of said central web for interlocking slidable engagement with the vertically extending T-grooves in said first and second sidewalls, respectively, and a cylindrical boss member integral with said central web and substantially equidistant between said first and second tongues, said boss member having an outer peripheral surface and a vertically extending bore therein for slidably receiving a vertical reinforcement bar therethrough, said central web having first and second inclined upper edges, said first upper edge descending from said first tongue toward said boss member and said second upper edge descending from said second tongue toward said boss member; whereby horizontally disposed reinforcement bars are receivable, respectively, at the intersection between said outer surface of said cylindrical boss and said first and second upper edges.

2. A modular wall construction system as set forth in claim 1 wherein said first and second sidewalls are of expanded foam plastic material.

3. A modular wall construction system as set forth in claim 2 wherein the expanded foam plastic material is polystyrene.

4. A modular wall construction system as set forth in claim 1 wherein the flowable material is concrete in slurry form.

5. A modular wall construction system as set forth in claim 1 wherein said first and second sidewalls are congruently shaped.

6. A modular wall construction system as set forth in claim 1 wherein each of the vertically extending T-grooves in said first and second sidewalls includes an enlarged channel for slidably receiving said associated tongue; and wherein each of said sidewalls includes opposed peninsulas adjacent said T-groove defining a reduced slot adjacent the associated enlarged channel for slidable reception of said central web.

7. A modular wall construction system as set forth in claim 1 including:

mutually interlocking means on said first and second sidewalls and on said bridge means for slidable reception of said bridge means with said first and second sidewalls in a first direction while preventing substantial movement therebetween in a second, transverse, direction.

8. A modular wall construction system as set forth in claim 1 wherein each of said first and second sidewalls is of substantially rectangular shape having upper and lower longitudinally extending surfaces and first and second interior surfaces, respectively, extending between said upper and lower surfaces and facing the cavity and having a plurality of longitudinally spaced vertical endwall mounting grooves therein, each said mounting groove extending from said upper surface to said lower surface; and including:

a pair of endwalls extending transversely of said first and second sidewalls at spaced locations along the length of said sidewalls, each of said endwalls having laterally projecting, vertically extending, ribs for fitting reception, respectively, with said endwall mounting grooves.

9. A modular wall construction system as set forth in claim 1 wherein each of said first and second sidewalls is of substantially rectangular shape having upper and lower longitudinally extending surfaces and first and second interior surfaces, respectively, extending between said upper and lower surfaces and facing the cavity and having a plurality of longitudinally spaced vertical endwall mounting grooves therein, each said mounting groove extending from said upper surface to said lower surface; and a pair of opposed, spaced apart, elongated, endwalls extending between upper and lower laterally extending surfaces;

interlocking means formed on said upper and lower surfaces of said sidewalls and said endwalls, said interlocking means including:

an elongated rail member extending along said upper surface of said sidewalls and said endwalls;

an elongated channel member extending along said lower surface of each of said sidewalls and endwalls;

said rail members of said upper surfaces being positioned to be interlocked within respective channel members of said lower surfaces of said sidewalls and of said endwalls, respectively, when a plurality of said sidewalls and said endwalls are stacked, respectively, in a vertical relationship to form a building structure.

10. A modular wall construction system as set forth in claim 1 wherein said central web of each of said bridge members is perforated to enable the flowable material to flow freely through and around said bridge members.

11. A modular wall construction system as set forth in claim 1 wherein each of said first and second sidewalls is of substantially rectangular shape having upper and lower longitudinally extending surfaces and exterior and interior surfaces extending between said upper and lower surfaces and a plurality of longitudinally spaced vertically disposed stress relief notches extending from said upper surface to said lower surface;

whereby said sidewalls can be manipulated from a flat planar condition to a curved planar condition being curved about a vertical axis which is substantially parallel to said vertically disposed notches.

12. A modular wall construction system as set forth in claim 11 including:

a pair of opposed, spaced apart, elongated, endwalls extending between upper and lower laterally extending surfaces; and means for joining a pair of said endwalls to said sidewalls at spaced apart locations among the length of said sidewalls.

13. A modular wall construction system as set forth in claim 1 including:

an elongated reinforcing bar received on each of said first and second inclined edges at the intersection between said outer surface of said cylindrical boss member and said first and second upper edges;

an elongated reinforcing bar received through the vertically extending bore in each of said cylindrical boss members; and concrete filling the cavity, thereby enveloping said reinforcing bars, said concrete originally introduced in the slurry form and subsequently cured to its hardened condition.

14. A modular wall construction system as set forth in claim 1 including:

an upright post integral with said central web and projecting upwardly from each of said first and second inclined upper edges at locations substantially equidistant from said first and second tongues, respectively, and spaced from said cylindrical boss member;

whereby reinforcement bars are receivable, respectively, at the intersection between said upright posts and said first and second upper edges.

15. A modular wall construction system comprising: first and second opposed, spaced apart, elongated sidewalls defining a cavity therebetween for receiving flowable material;

a plurality of transverse bridge members for maintaining spacing between said first and second sidewalls, each of said bridge members having opposed ends for fixed attachment to said first and second sidewalls, respectively, at spaced locations along the length thereof, each of said bridge members including first retention means for slidably receiving a substantially vertical reinforcement bar and second retention means for slidably receiving a substantially horizontal reinforcement bar;

each of said first and second sidewalls being of substantially rectangular shape having upper and lower longitudinally extending surfaces and first and second interior surfaces, respectively, extending between said upper and lower surfaces and facing the cavity and having a plurality of longitudinally spaced vertical T-grooves therein, each T-groove extending from said upper surface and terminating at a shoulder intermediate said upper and lower surfaces;

each of said bridge members including a central web extending between first and second tongues extending transversely of said central web for interlocking slidable engagement with the vertically extending T-grooves in said first and second sidewalls, respectively;

said first retention means including a cylindrical boss member integral with said central web and substantially equidistant between said first and second tongues, said boss member having an outer peripheral surface and a vertically extending bore therein for slidably receiving a vertical reinforcement bar therethrough; and said central web having first and second inclined upper edges, said first upper edge descending from said first tongue toward said boss member and said second upper edge descending from said second tongue toward said boss member;

whereby reinforcement bars are receivable, respectively, at the intersection between said outer surface of said cylindrical boss and said first and second upper edges.

16. A transverse bridge member for maintaining spacing between first and second spaced opposed sidewalls of a modular wall construction system comprising:

a central web extending between first and second tongues extending transversely of said central web for interlocking slidable engagement with vertically extending T-grooves in the first and second sidewalls, respectively; and a cylindrical boss member integral with said central web and substantially equidistant between said first and second tongues, said boss member having an outer peripheral surface and a vertically extending bore therein for slidably receiving a vertical reinforcement bar therethrough, said central web having first and second inclined upper edges, said first upper edge descending from said first tongue toward said boss member and said second upper edge descending from said second tongue toward said boss member;

whereby horizontally disposed reinforcement bars are receivable, respectively, at the intersection between said outer surface of said cylindrical boss and said first and second upper edges.

17. A modular wall construction system as set forth in claim 16 including:

an upright post integral with said central web and projecting upwardly from each of said first and second inclined upper edges at locations substantially equidistant from said first and second tongues, respectively, and spaced from said cylindrical boss member;

whereby reinforcement bars are receivable, respectively, at the intersection between said upright posts and said first and second upper edges.

* * * * *